US005729090A

United States Patent [19]

Scott et al.

[11] Patent Number: 5,729,090

[45] Date of Patent: Mar. 17, 1998

[54] SODIUM HALIDE DISCHARGE LAMP

[75] Inventors: Curtis E. Scott, Mentor; Joseph A. Shrawder, Solon; Mohan Rajaram, Mentor, all of Ohio

[73] Assignee: General Electric Company, Schenectady, N.Y.

[21] Appl. No.: 391,819

[22] Filed: Feb. 21, 1995

[51] Int. Cl.[6] ..... H01J 17/16; H01J 17/20

[52] U.S. Cl. ..... 313/637; 313/636; 313/571; 313/573; 313/638; 313/639; 313/640; 313/641; 313/642; 501/54; 501/154

[58] Field of Search ..... 313/570, 571, 313/573, 636, 637, 638, 639, 640, 641, 642, 493; 501/53, 54, 154, 905

[56] References Cited

U.S. PATENT DOCUMENTS

| | | | |
|---|---|---|---|
| 2,658,984 | 11/1953 | Mohn | 501/54 X |
| 3,563,772 | 2/1971 | Jacobus et al. | 313/636 X |
| 3,639,801 | 2/1972 | Jacobs et al. | 313/636 X |
| 3,764,286 | 10/1973 | Antczak et al. . | |
| 3,911,308 | 10/1975 | Akutsu et al. | 313/567 |
| 4,047,067 | 9/1977 | Clausen | 313/567 |
| 4,156,826 | 5/1979 | Hernqvist | 313/636 X |
| 4,248,732 | 2/1981 | Myers et al. | 501/48 |
| 4,272,703 | 6/1981 | Eckberg | 313/493 |
| 4,277,716 | 7/1981 | Banks, Jr. et al. | 313/623 |
| 4,361,779 | 11/1982 | Van Der Steen et al. | 313/636 |
| 4,501,993 | 2/1985 | Mueller et al. | 313/636 X |
| 4,574,218 | 3/1986 | Batemen, Jr. et al. | 313/636 X |
| 4,684,847 | 8/1987 | Spierings et al. | 313/636 X |
| 4,798,995 | 1/1989 | Gilliard et al. | 313/638 |
| 4,810,938 | 3/1989 | Johnson et al. | 315/248 |
| 4,862,886 | 9/1989 | Clarke et al. | 315/248 |
| 4,890,042 | 12/1989 | Witting | 313/642 |
| 4,918,352 | 4/1990 | Hess et al. | 313/25 |
| 5,021,703 | 6/1991 | Passmore et al. | 313/25 |
| 5,032,762 | 7/1991 | Spacil et al. | 313/635 |
| 5,057,743 | 10/1991 | Krasko et al. | 313/639 |
| 5,073,831 | 12/1991 | Flint | 359/845 |
| 5,141,786 | 8/1992 | Shimizu et al. | 501/54 X |
| 5,144,201 | 9/1992 | Graham et al. | 313/634 |
| 5,150,015 | 9/1992 | Heindl et al. | 315/248 |
| 5,159,229 | 10/1992 | Passmore et al. | 313/25 |
| 5,212,424 | 5/1993 | Russell et al. | 313/639 |
| 5,306,987 | 4/1994 | Dakin et al. | 315/248 |

FOREIGN PATENT DOCUMENTS

A-0178026 4/1986 European Pat. Off. .

*Primary Examiner*—Ashok Patel
*Attorney, Agent, or Firm*—George E. Hawranko

[57] ABSTRACT

A sodium containing lamp constructed to include of a fused quartz or fused silica arc chamber wherein the fused quartz and/or fused silica contains less than about 0.05 parts per million sodium. The arc chamber of the invention demonstrates a resistance to sodium diffusion resulting in a longer lived lamp with excellent color maintenance.

20 Claims, 2 Drawing Sheets

SODIUM HALIDE DISCHARGE LAMP

BACKGROUND OF THE INVENTION

This invention relates to sodium containing lamps. More particularly, this invention relates to a new and improved arc discharge chamber that resists sodium diffusion. The invention is particularly suited to slowing sodium ion diffusion through the arc chamber of sodium containing metal halide lamps.

Throughout the specification, numerous references will be made to use of the arc discharge chamber in a sodium containing metal halide lamp, and certain prior art sodium metal halide arc discharge lamps will be discussed. However, it should be realized that the invention could be utilized in other lamp applications where sodium diffusion is undesirable.

Metal halide arc discharge lamps in which the arc discharge chamber of this invention is suitable, but not limited to, are demonstrated in U.S. Pat. Nos. 4,047,067 and 4,918,352 (electroded), and 5,032,762 (electrodeless), the disclosures of which are herein incorporated by reference. Metal halide lamps of this type generally are comprised of an arc discharge chamber surrounded by a protective envelope. The arc chamber includes a fill of light emitting metals including sodium and rare earth elements such as scandium, indium, dysprosium, neodymium, praseodymium, cerium, and thorium in the form of halides, optionally mercury, and optionally an inert gas, such as krypton or argon. U.S. Pat. No. 4,798,895, herein incorporated by reference, describes a composition for the metal halide dose particularly suited to the present invention.

Unfortunately, the life of these lamps is frequently limited by the loss of the sodium portion of the metal halide fill during lamp operation due to sodium ion diffusion. Particularly, typical fused silica or fused quartz is relatively porous to a sodium ion, and during lamp operation, energetic sodium ions pass from the arc plasma through the silica or quartz wall and condense in the region between the arc chamber and the outer jacket or envelope of the lamp. The lost sodium is then unavailable to the arc discharge and can no longer contribute its characteristic emissions, causing the light output to gradually diminish and the color to shift from white towards blue. In addition, the arc becomes more constricted, and in a horizontally operated lamp, the arc may bow against and soften the arc chamber wall. Sodium loss may also cause the operating voltage of the lamp to increase to the point where the arc can no longer be sustained by the ballast and catastrophic failure results.

In an attempt to reduce the effects of sodium diffusion through the arc discharge chamber, the art has typically relied on coating of the chamber with sodium diffusion resistant materials. Attempts to solve sodium diffusion problems have included depositing aluminum silicate and titanium silicate layers on the outside surfaces of the arc tube, as described in U.S. Pat. Nos. 4,047,067 and 4,017,163 respectively. Alternatively, U.S. Reissue Pat. No. 30,165, coats vitreous metal phosphates and arsenates on the inner surfaces of the arc tube. In contrast, U.S. Pat. No. 3,984,590 discloses an aluminum phosphate coating, while U.S. Pat. No. 5,032,762 discloses beryllium oxide coatings.

While these methods have met with success in minimizing sodium diffusion, these methods also require additional raw materials and manufacturing steps. Accordingly, it would be desirable in the art to have a simplified, cost-effective manner of reducing sodium diffusion.

SUMMARY OF THE INVENTION

It is a primary object of this invention to provide a new and improved arc discharge chamber which minimizes sodium diffusion.

It is an advantage of this invention to provide a new and improved arc discharge chamber having a low susceptibility to sodium diffusion.

It is a still further advantage of this invention to provide a longer lived, higher quality, sodium-containing lamp.

A further advantage of this invention is to provide a new and improved, low-cost, readily-manufactured, long lived, sodium halide arc discharge lamp having a reduced capacity for sodium diffusion.

Additional objects and advantages of the invention will be set forth in part in the description which follows and in part will be obvious from the description, or may be learned by practice of the invention. The objects and advantages of the invention may be realized and attained by means of the instrumentalities and combinations particularly pointed out in the appended claims.

To achieve the foregoing objects and in accordance with the purpose of the invention, the sodium containing lamp of this invention comprises a fused quartz or a fused silica arc chamber comprised of silica or quartz containing less than about 0.05 parts per million sodium. As used throughout this application, fused silica represents synthetic silica sand, fused quartz encompasses refined quartz sand, and both may be referred to as glasses.

In a preferred embodiment of the invention, a sodium metal halide lamp is comprised of an arc chamber of fused silica or fused quartz comprised of less than about 0.05 parts per million sodium.

A particularly preferred fused silica or fused quartz composition forming the arc chamber of the sodium containing lamp will include less than about 0.1 parts per million lithium, less than about 0.1 parts per million potassium, less than about 0.1 parts per million cesium, less than about 0.2 parts per million iron, and less than about 0.05 parts per million chromium.

More preferably, the arc chamber composition will include less 0,025 parts per million sodium, less than about 0.7 parts per million lithium, less than about 0.07 parts per million potassium, less than about 0.07 parts per million cesium, and less than about 0.10 parts per million iron.

BRIEF DESCRIPTION OF THE DRAWINGS

The invention consists in the novel parts, construction, arrangements, combinations, and improvements shown and described in the accompanying drawings which are incorporated in and constitute a part of this specification, illustrate one embodiment of the invention and, together with the description, serve to explain the principles of the invention.

DETAILED DESCRIPTION OF THE INVENTION

Reference will now be made in detail to the present preferred embodiment of the invention, an example of which is illustrated in the accompanying drawings.

While the invention will be described in connection with a preferred embodiment, it will be understood that it is not intended to limit the invention to that embodiment. On the contrary, it is intended to cover all alternatives, modifications, and equivalents as may be included within the spirit and scope of the invention as defined by the appended claims.

Figure 1:
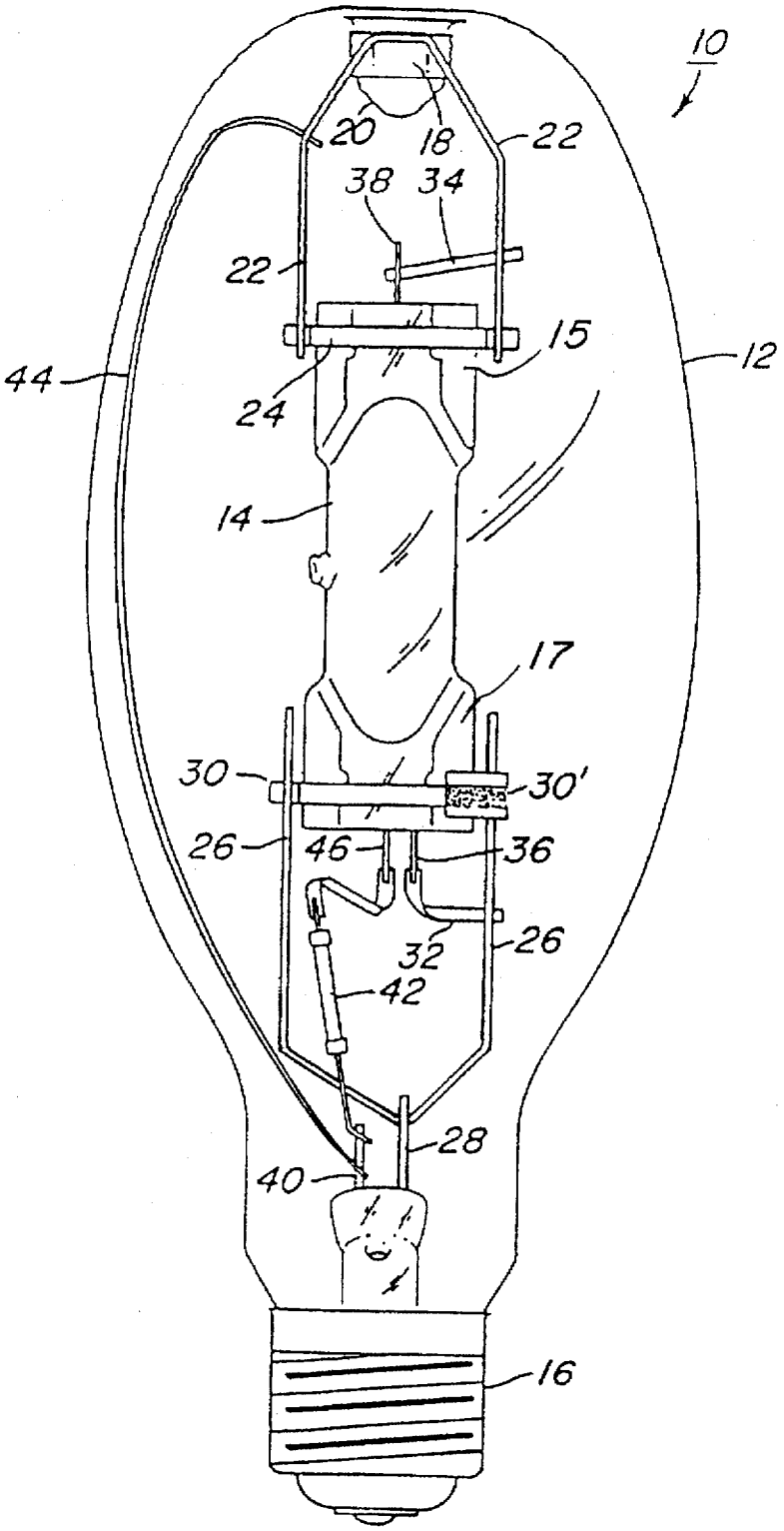
FIG. 1 is a schematic illustration of a metal halide arc discharge lamp including an arc discharge chamber according to the present invention; and, FIG. 2 is a graphical representation of the resistivity of various fused quartz compositions within the scope of this invention and comparative examples.

Referring now to FIG. 1, it may be seen that lamp 10 is comprised of an outer envelope 12 made of a light-transmissive vitreous material, such as glass and a light-transmissive arc chamber 14 made of fused silica or fused quartz having a sodium content less than about 0.05 parts per million. Lamp 10 further comprises a base 16 having suitable electrical contacts for making electrical connection to the electrodes in arc chamber 14. Although the lamp shown in FIG. 1 is an electroded lamp, the inventive chamber is equally applicable to an electrodeless metal halide arc discharge lamp.

In the embodiment shown, arc chamber 14 is held in place within envelope 12 by frame parts comprising a spring clip metal band 18 surrounding a dimple 20 in envelope 12. Support 22 is spot welded to band 18 and also spot welded to strap member 24. Strap member 24 is securely and mechanically fastened about the pinch seal region of arc chamber 14. The other end of the arc chamber is secured by support member 26 which is spot welded at one end to electrically conductive terminal 28 and welded at the other end to strap member 30. Strap member 30 is securely mechanically fastened about the second pinch seal region 17 of the arc chamber 14. Conductive members 32 and 34 are spot welded at one end to support members 26 and 22, respectively, and at the other end to inleads 36 and 38, respectively, of the respective arc chamber 14 electrodes (not shown). Electrically conductive member 40 is spot welded to resistor 42 and current conductor 44. The other end of resistor 42 is connected to the inlead 46 of a starting electrode (not shown). Except for conductor 44 and inleads 36, 38, and 46 which are made of molybdenum, and the actual resistor portion of resistor 42, all of the frame parts may be made of a nickel-plated steel. The lamp also contains a getter strip 30' coated with a metal alloy material primarily to get or absorb hydrogen from inside the lamp envelope.

In the present preferred embodiment of the invention, the arc discharge chamber 14 is comprised of a fused quartz or a fused silica including less than about 0.05 parts per million sodium. In a particularly preferred embodiment, the quartz or silica will include less than 0.10 parts per million lithium, potassium, cesium, and/or iron. In a more preferred embodiment, the quartz or silica will include less than 0.07 parts per million lithium, potassium, cesium, iron, and/or chromium. Of course, the quartz or silica may contain other elements, such as aluminum, arsenic, boron, calcium, cadmium, copper, magnesium, manganese, nickel, phosphorous, antimony, and zirconium. Many of these are present at trace levels as contaminates from production of the glass. However, large quantities of these transition metals would have undesirable effect on the color of the arc chamber and should be avoided.

A fused quartz meeting the requirements of the invention includes highly purified, refined sand. Fused quartz of this type is available from the GE Quartz Department under the tradename GE 244. High purity fused silica suitable in the subject invention is available via various synthetic processes including tetraethylorthosilicate hydrolysis and $SiCl_4$ combustion reactions. Fused silicas of these types are available from the General Electric Company as tradename GE 021 glass. These glasses have heretofore been used in semiconductor manufacturing applications.

Without being bound by theory, it is believed that the alkali metals present in a glass act as migration channels by which a sodium ion in the lamp fill can diffuse through the quartz or silica chamber walls. As described above, this diffusion from the high energy, high temperature inner wall to the exterior wall of the arc chamber destroys lamp function. Accordingly, minimizing these channels by reducing sodium ion concentration is believed to result in an arc chamber resistant to sodium diffusion and an improved lamp. It is also believed that within the alkali metals group, sodium in the quartz or silica is the greatest contributor to sodium diffusion.

To further exemplify the theory, but not to limit the invention, the following examples demonstrate advantageous properties of the subject invention.

EXAMPLE I

Three fused silica glasses having the compositions depicted in Table 1 were evaluated for sodium diffusion characteristics.

TABLE 1

| Glass | Al | As | B | Ca | Cd | Cr | Cu | Fe | K | Li |
|---|---|---|---|---|---|---|---|---|---|---|
| 1 | 14 | <0.002 | <0.2 | 0.4 | <0.01 | <0.05 | <0.05 | 0.2 | 0.8 | 0.8 |
| 2 | 8 | <0.002 | <0.1 | 0.8 | <0.01 | <0.05 | <0.01 | 0.2 | <0.2 | 0.001 |
| 3 | 0.2 | — | — | <0.05 | <0.01 | <0.05 | <0.05 | 0.07 | <0.05 | <0.05 |

| Glass | Mg | Mn | Na | Ni | P | Sb | Ti | Zr | OH |
|---|---|---|---|---|---|---|---|---|---|
| 1 | 0.1 | <0.05 | 0.7 | <0.1 | <0.2 | <0.003 | 1.1 | 0.8 | <5 |
| 2 | <0.1 | <0.03 | 0.1 | <0.1 | <0.2 | <0.003 | 1.4 | 0.3 | 10 |
| 3 | <0.05 | <0.02 | <0.05 | — | — | — | <0.02 | <0.02 | 10 |

Each of these fused silica glasses were obtained from the General Electric Company, Quartz Department, Campbell Road, Willoughby, Ohio. Glass 1 was GE type 214 glass; Glass 2 was GE type 244 LD glass; and, Glass 3 was GE type 021 glass. Each of these glass compositions were formed into rectangular samples prepared by fusing the silica/quartz in molybdenum foil boats at 1800° under a hydrogen atmosphere in a high temperature Brew furnace. Each rectangular ingot was analyzed utilizing the ASTM D257-78 method to determine the volume resistivity of the fused material. Conductivity, or alternatively resistivity are accepted in the art as representing the potential for sodium diffusion in a particular glass composition. Moreover, the lower the resistivity or the higher the conductivity, the greater the sodium diffusion will be. The log resistivity for each sample is depicted in Table 2. These results are also graphically represented by FIG. 2.

TABLE 2

| Temperature (°C.) | Temperature (1000/K.) | GLASS 1 LOG RHO (OHM-CM) | GLASS 2 LOG RHO (OHM-CM) | GLASS 3 LOG RHO (OHM-CM) |
|---|---|---|---|---|
| 307 | 1.72 | 9.85 | 10.77 | 10.99 |
| 400 | 1.49 | 8.54 | 9.21 | 9.81 |
| 501 | 1.29 | 7.63 | 8.10 | 9.04 |
| 602 | 1.14 | 6.96 | 7.37 | 8.52 |
| 702 | 1.03 | 6.49 | 6.89 | 8.17 |
| 802 | 0.93 | 6.15 | 6.56 | 7.94 |
| 905 | 0.85 | 5.85 | 6.29 | 7.70 |
| 1001 | 0.78 | 5.66 | 6.11 | 7.38 |

Figure 2:
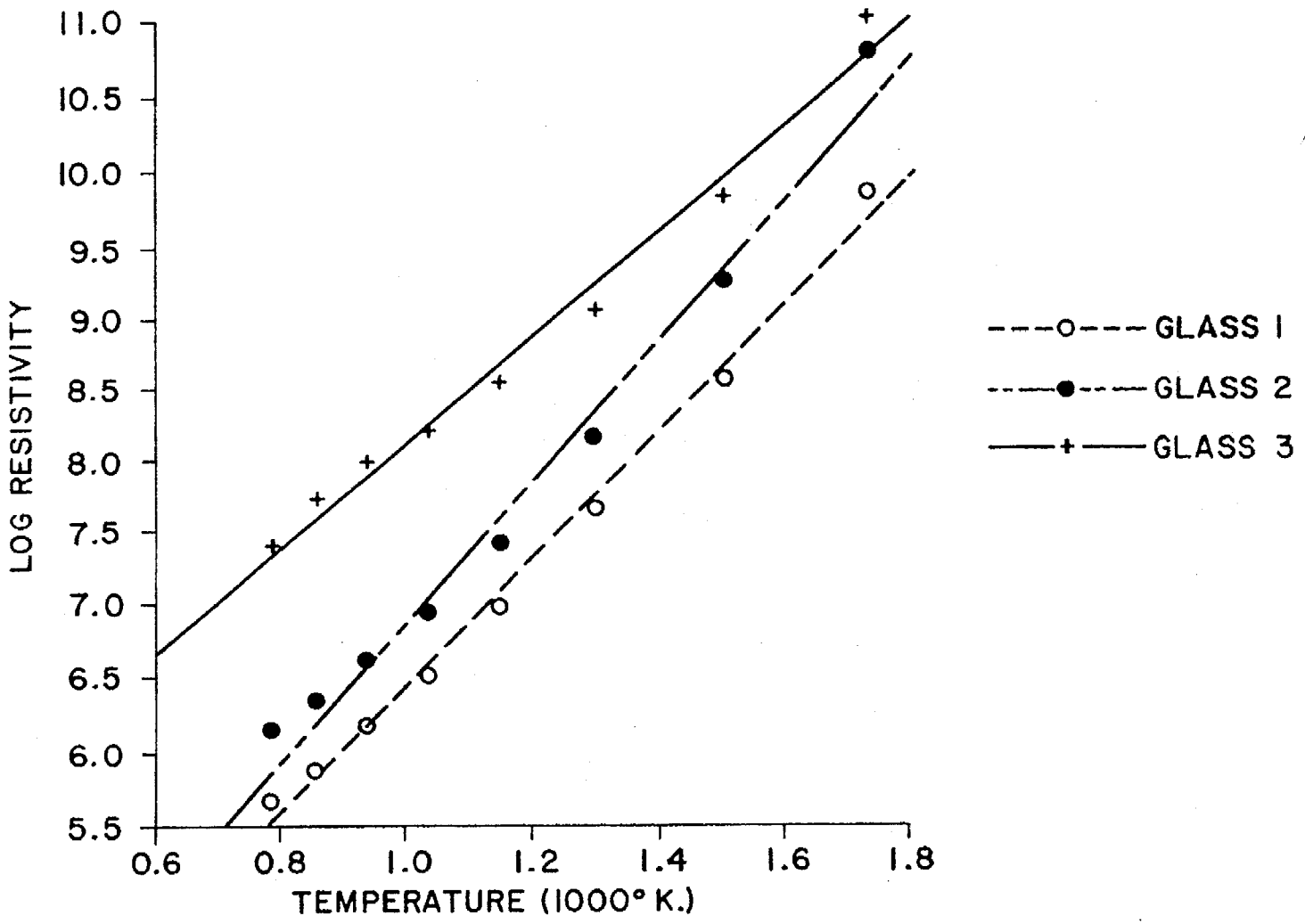

It can be seen from Table 2 and FIG. 2 that a fused glass composition having a sodium content below 0.05, parts per million demonstrates a superior volume resistivity. Accordingly, Glass 3, with a sodium content below about 0.05 parts per million, has the lowest sodium diffusion potential. It should be noted that Glass 1 is incorporated into most metal halide lamps sold today.

EXAMPLE II

Forty-four 400 watt sodium containing metal halide lamps were made from glass no. 1 and fifteen 400 watt sodium containing metal halide lamps were made from glass no. 3. Particularly, quartz having the respective compositions of Table 1 was formed into lamps similar in design to the lamp described in U.S. Pat. No. 4,798,995 using a standard lamp assembly process each lamp included an arc tube 8 mm(ID) by 10 mm(OD) formed according to the process described in U.S. Pat. No. 3,764,286, herein incorporated by reference. In each lamp, the arc tube included a 30 milligram dose comprised of 89.7 percent by weight NaI, 8.5 percent by weight $ScI_3$, and 1.8 percent by weight $ThI_4$. Lamps were operated for 100 hrs. and the performances were determined using an integrated sphere photometer. Lamps using glass no. 3 to form the arc tube material showed an average increase of 600 lumens over similar lamps processed with glass no. 1 (Table 3). Additional lumen gain is expected by a slower rate of sodium loss from the arc tube during lamp operation.

TABLE 3

Performance of 400 Watt Metal Halide Lamps Using High Purity Quartz

| Quartz | Average Lumens Output (at 100 hrs.) |
|---|---|
| Glass No. 1 | 44620 |
| Glass No. 3 | 45223 |

Thus, it is apparent that there has been provided, in accordance with the invention, an arc chamber for a sodium containing lamp that fully satisfies the objects, aims, and advantages set forth above. While the invention has been described in conjunction with the specific embodiments thereof, it is evident that many alternatives, modifications, and variations will be apparent to those skilled in the art in light of the foregoing description. Accordingly, it is intended to embrace all such alternatives, modifications, and variations that fall within the spirit and broad scope of the appended claims.

What we claim as new and desire to secure by Letters Patent of the United States is:

1. A lamp containing a fill including sodium halide comprised of an arc chamber comprised of a predominantly a fused silica including between greater than 0 and about 0.05 parts per million sodium.

2. The lamp of claim 1 wherein said silica is comprised of less than about 0.025 parts per million sodium.

3. The lamp of claim 1 wherein said silica includes less than about 0.1 parts per million lithium, less than about 0.1 parts per million potassium, and less than about 0.1 parts per million cesium.

4. The lamp of claim 1 wherein said fused silica includes less than about 0.2 parts per million iron and less than about 0.05 parts per million chromium.

5. The lamp of claim 4 wherein said fused silica includes less than about 0.07 parts per million iron.

6. The lamp of claim 1 wherein said fill further comprises mercury.

7. The lamp of claim 1 wherein said fill further comprises at least one halide of an element selected from the group consisting of scandium, indium, dysprosium, neodymium, praseodymium, cerium, and thorium.

8. The lamp of claim 7, wherein said halide is iodide.

9. The lamp of claim 1 wherein said sodium halide is a sodium iodide.

10. The lamp of claim 1 wherein said fill further comprises an inert starting gas selected from the group consisting of krypton, argon, neon, and xenon.

11. A lamp containing a fill including sodium halide comprised of an arc chamber comprised predominantly of quartz having between greater than 0 and about 0.05 parts per million sodium.

12. The lamp of claim 11 wherein said quartz is comprised of less than about 0.025 parts per million sodium.

13. The lamp of claim 11 wherein said fused quartz includes less than about 0.1 parts per million lithium, less than about 0.1 parts per million potassium, and less than about 0.1 parts per million cesium.

14. The lamp of claim 11 wherein said fused quartz comprises less than about 0.2 parts per million iron and less than about 0.2 parts per million chromium.

15. The lamp of claim 14 wherein said fused silica includes less than about 0.07 parts per million iron.

16. The lamp of claim 11 wherein said fill further comprises mercury.

17. The lamp of claim 11 wherein said fill further comprises at least one halide of an element selected from the group consisting of scandium, indium, dysprosium, neodymium, praseodymium, cerium, and thorium.

18. The lamp of claim 17 wherein said halide is iodide.

19. The lamp of claim 11 wherein said sodium halide is a sodium iodide.

20. The lamp of claim 11 wherein said fill further comprises an inert starting gas selected from the group consisting of krypton, argon, neon, and xenon.

* * * * *